US009004328B1

(12) United States Patent
Galuppo, Jr.

(10) Patent No.: US 9,004,328 B1
(45) Date of Patent: Apr. 14, 2015

(54) ADJUSTABLE, STEALTH OF MOVEMENT, QUICK-DRAW, CROSS-DRAW HOLSTER FOR A REVOLVER

(71) Applicant: Daniel Galuppo, Jr., Georgetown, NY (US)

(72) Inventor: Daniel Galuppo, Jr., Georgetown, NY (US)

( * ) Notice: Subject to any disclaimer, the term of this patent is extended or adjusted under 35 U.S.C. 154(b) by 60 days.

(21) Appl. No.: 14/019,912

(22) Filed: Sep. 6, 2013

(51) Int. Cl.
*F41C 33/00* (2006.01)
*F41C 33/02* (2006.01)

(52) U.S. Cl.
CPC ..... *F41C 33/0272* (2013.01); *Y10S 224/912* (2013.01)

(58) Field of Classification Search
USPC ..... 224/192–193, 198, 238, 243, 912
See application file for complete search history.

(56) References Cited

U.S. PATENT DOCUMENTS

| | | | |
|---|---|---|---|
| 3,353,728 | A | 11/1967 | Freed |
| 3,910,469 | A | 10/1975 | Baldocchi |
| 3,915,361 | A | 10/1975 | Perkins |
| 3,923,214 | A | 12/1975 | Kippen |
| 5,419,472 | A | 5/1995 | Hellweg et al. |
| 5,622,295 | A | 4/1997 | Hellweg et al. |

*Primary Examiner* — Justin Larson
*Assistant Examiner* — Phillip Schmidt
(74) *Attorney, Agent, or Firm* — Mark Levy; Hinman, Howard & Kattell, LLP

(57) ABSTRACT

A quick-draw, stealth of movement, cross draw holster with stealth of movement for use specifically with revolvers. A pair of adjustable jaws having segmented faces grips the revolver only in the cylinder region. This support arrangement allows a very quick withdrawal of the revolver from the holster, typically requiring movement on the order of between one and two inches before the revolver is totally clear of the holster. The cylinder clamping support arrangement easily accommodates revolvers having scopes or other similar attached accessories. The holster may be either belt worn or strap-supported for over-the-shoulder mounting and can be used by either right- or left-handed shooters.

16 Claims, 4 Drawing Sheets

ADJUSTABLE, STEALTH OF MOVEMENT, QUICK-DRAW, CROSS-DRAW HOLSTER FOR A REVOLVER

FIELD OF THE INVENTION

The invention pertains to holsters and, more particularly to an adjustable, cross draw, stealth of movement holster, for a revolver that accommodates accessories such as a scope attached to the revolver.

BACKGROUND OF THE INVENTION

Throughout the history of the handgun, pistols (e.g., revolvers) have typically been carried on the body of a user or shooter in a holster. Historically, pistols have been worn or carried on the shooter in leather holsters, typically strapped to the waist or chest. These leather holsters would nearly encase the pistol fully to hold it securely in place, usually in a barrel-down orientation. The pistol would be inserted into and withdrawn from the holster via an opening in the top of the holster.

A major disadvantage of such conventional leather holsters lies in the fact that in order to draw the pistol for shooting, the pistol must first be lifted upward a distance somewhat greater than the length of the barrel until the end of the barrel clears the top of the holster. The pistol must then be leveled for aiming and firing. Holsters of the prior art fail to provide stealth of movement which has proven a hindrance in hunting, law enforcement, and other such fields in which a pistol is worn and used. This excess motion problem is illustrated when one envisions a hunter in the woods stalking his prey. The hunter proceeds to draw his or her safely-holstered gun and with compounded movement, alerts the prey that then escapes before the hunter can fire a shot.

Another difficulty with conventional leather holsters is that their bulk makes concealing a pistol difficult. In addition, the general bulkiness of traditional leather holsters often makes them uncomfortable to wear. Also, the holster may shift, making quick pistol withdrawal uncertain. Finally, traditional leather holsters tend to pinch the revolver, again making quick withdrawal of the pistol from the holster problematic.

In summary, leather holsters, while functional, durable, and attractive typically do not provide an ideal solution to quick weapon withdrawal.

DISCUSSION OF THE RELATED ART

Many attempts have been made to design a suitable holster for revolvers and other handguns. For example, U.S. Pat. No. 3,353,728 for PISTOL HOLDER, issued Nov. 21, 1967 to George H. Freed, discloses a simple, wire frame holder for securing a revolver-style pistol to a user's belt. A member of the FREED apparatus is slid into the tip of the pistol's barrel while the weight of the pistol rests on the other portion of the wire frame. The FREED holster may be oriented for either normal, forward draw or for reverse, cross draw.

U.S. Pat. No. 3,910,469 for HOLSTER FOR HAND GUNS, issued Oct. 7, 1975 to Archie Baldocchi, teaches another quick draw style holster formed from a channel member shaped to conform to a portion of the body of a handgun adjacent the trigger guard.

U.S. Pat. No. 3,915,361 for HOLSTER WITH ADJUSTABLE MOUNTING CLIP, issued Oct. 28, 1975 to Neale A. Perkins, discloses a paddle-style holster adjustable for either normal, forward draw or reverse, cross draw orientations.

U.S. Pat. No. 3,923,214 for HOLSTER, issued Dec. 2, 1975 to Albert J. Kippen, discloses a one-piece holster for a revolver. A pair of opposing sides forms a pocket to receive and grip the cylinder portion of the revolver when it is fully inserted in the holster. The KIPPEN holster features an adjustment whereby the breakaway force required to withdraw the pistol from the holster may be varied.

U.S. Pat. No. 5,622,295 for HOLSTER FOR HANDGUNS OR THE LIKE, issued Apr. 22, 1997 to Albert W. Hellweg, et al., discloses a holster for a handgun comprising a holster body for receiving the handgun, the holster body being mounted on a belt receiving member; the holster body having an open top for receiving the handgun, and an open bottom to allow a barrel of the handgun to project therethrough if required; the holster body is of a folded construction having two substantially parallel but spaced apart ends shaped to conform with the barrel and/or slide of the handgun to define an open side therebetween, there being provided at least one adjustable tension means passing between the ends and across the open side to retain the ends in a desired but adjustable spaced relationship.

U.S. Pat. No. 5,419,472 for HOLSTER FOR GUNS OR THE LIKE issued May 30, 1995 to HELLWEG et al., discloses a holster gun comprising a pouch for receiving the gun, the pouch being mounted to the belt-receiving member; the belt-receiving member having an elongate slot therein, the pouch being mounted to the belt-receiving member by a fastener passing through the elongate slot, the fastener being selectively releasable to allow the pouch to be moved axially relative to the belt-receiving member by moving the fastening along the slot, and the pouch being rotatable about the fastener.

None of these prior art patents shows or suggests, individually, or taken in any combination, the novel holster of the present invention.

SUMMARY OF THE INVENTION

The present invention provides a quick-draw, cross draw holster for use specifically with revolvers, including revolvers having an attached accessory such as a scope or other optical device. A pair of adjustable jaws grips the revolver only in the cylinder region thereof. This support arrangement allows a very quick withdrawal of the revolver from the holster, typically requiring movement on the order of between one and two inches before the revolver is totally clear of the holster. The novel cylinder clamping support arrangement easily accommodates revolvers having scopes or other attached accessories. The holster of the invention may be either belt worn or strap supported for over-the-shoulder mounting. Moreover, the holster is usable for either right- or left-handed shooters.

It is, therefore, an object of the invention to provide a quick-draw holster requiring only limited movement of the revolver to completely clear the holster when withdrawing the revolver therefrom.

It is another object of the invention to provide a holster which supports a revolver only by the revolver's cylinder.

It is a further object of the invention to provide a holster that readily accommodates a revolver either with or without an attached scope or similar accessory.

It is yet another object of the invention to provide a holster which is rugged and mechanically stable.

It is an additional object of the invention to provide a holster that is weatherproof.

It is a still further object of the invention to provide a holster that is easily adjustable to accommodate a revolver of any size.

It is another object of the invention to provide a holster that may be easily manufactured from molded or machined metals, or polymers such as Nylon® or Delron®.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
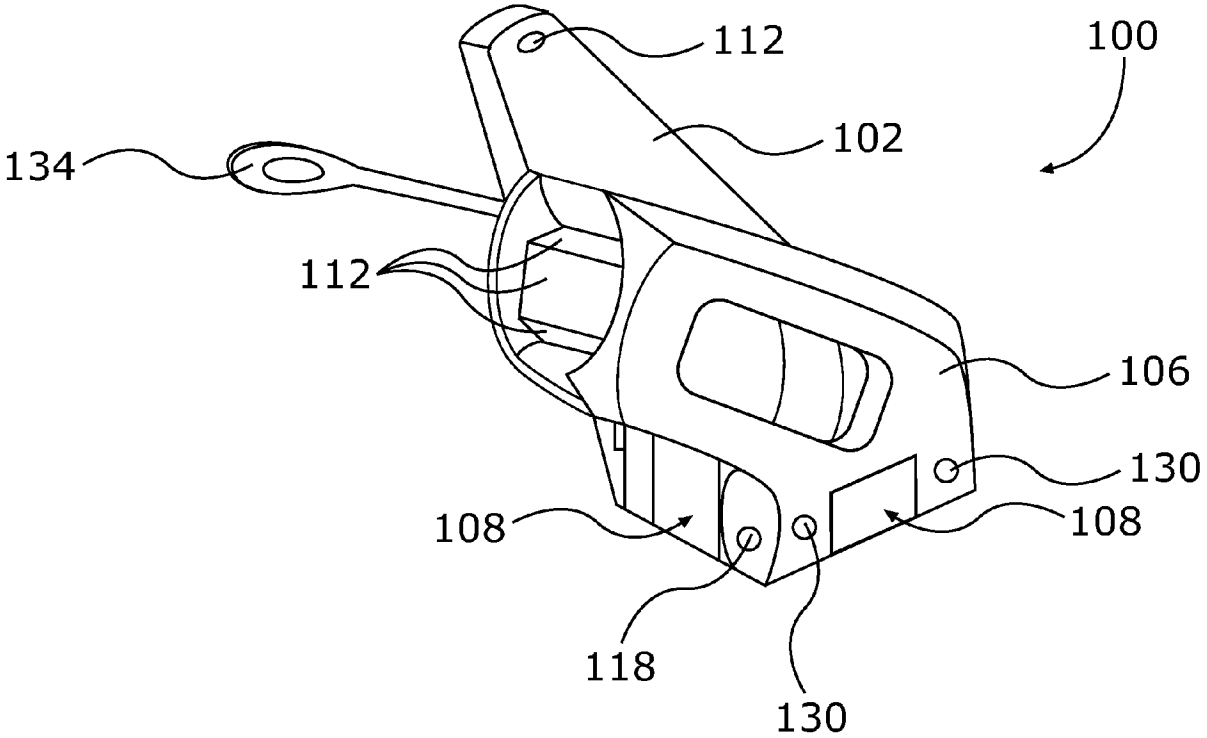
FIG. 1 is a perspective, assembly view of the holster in accordance with the present invention.

Generally speaking, the holster of the present invention has a pair of jaws, one fixed and one adjustable with respect to the fixed jaw, that grip the revolver only in the cylinder region thereof. The inner jaw and the outer jaw each have two spaced-apart finger protrusions extending downwardly therefrom. A spacer block has a 3-dimensional plus (+) shape and abuts the finger protrusions of both inner and outer jaws. A pivot pin connects the finger protrusions extending downwardly from the outer jaw and the spacer block.

Referring to FIGS. 1, 2, 3, and 4, there are shown perspective, front elevational, side elevational, and exploded perspective views, respectively, of the holster of the present invention, generally at reference number 100. The holster 100 is assembled from four major structural elements a back plate 102, inside jaw member 104, outside jaw member 106, and spacer block 108.

Both inside jaw member 104 and outside jaw member 106 have vertical protrusion blocks 104', 106', respectively, that extend downwardly, forming respective cavities 107, 109 therebetween.

Back plate 102 is the support structure upon which inside jaw member 104, outside jaw member 106, and spacer block 108 are mounted. In addition, the lower portion of back plate 102 contains a recessed region 110 to accommodate a wearer's belt, not shown. A hole 112 in back plate 102 is useful for attaching holster 100 to a strap, not shown, for over-the-shoulder mounting of holster 100. Back plate 102 also contains an attachment hole 124 for hammer retaining loop 134. Hammer retaining loop 134 is typically made from plastic or leather and may be adjustable. Hammer retaining loop 134 may be placed over the revolver's hammer spur, not shown, to help secure the revolver in the holster and to help prevent accidental cocking of the revolver. Hammer retaining loop 134 is typically retained in hole 124 by a lock screw, not shown.

Inside jaw member 104 is attached to back plate 102 by means of fasteners, typically self-taping screws, not shown, which pass through holes 114 in back plate 106, through holes 116 in finger portions 104' of inner jaw member 104 and into pre-drilled holes. Spacer block 108 is adapted to receive the self-tapping screws. Inner jaw member 104 has three outward-facing faces 126 displaced from one another by an angle $\alpha$. Angle $\alpha$ is typically approximately 45°. The angled faces 126 of both inner jaw member 104 and outer jaw member 106 are adapted to surround and enclose the chamber of a revolver, not shown. It will be recognized by those of skill in the art that a different number of faces 126 and/or a value of $\alpha$ other than 45° could be chosen to meet a particular operating circumstance or environment. Consequently, the invention is not considered limited to the embodiment chosen for purposes of disclosure.

Spacer block 108 is affixed to inner jaw member 104 at a lower portion thereof by screws 136, which go through back both back plate 102 and the finger protrusions 104' of inner jaw member 104 and screw into spacer block 108. Screw 138 is typically located at the upper portion of back plate 102 above belt loop area 110 and screws only into inner jaw member 104.

Outer jaw 106 is rotatably affixed to spacer block 108 by means of a pivot pin 118 which is threaded and passes through a front one of holes 120 in the front finger protrusion 106' of outer jaw member 106, holes 122 in spacer block 108, and finally through the rear finger protrusion 106' of outer jaw member 106. Thus, pivot pin 118 extends through both finger protrusions 106' extending from outer jaw member 106. A clip, cotter pin, split pin, etc., not shown, secures pin 118 in place. The use of such clips, cotter pins, split pins, or the like for retaining a pin are well known to those of skill in the art and are not described further herein.

In the same manner as inner jaw member 104 described hereinabove, an inner face of outer jaw member 106 is equipped with three faces angularly disposed with respect to one another by an angle $\alpha$. Angle $\alpha$ is typically approximately 45°. Surface 128 of outer jaw member 106 is slightly rounded so as to allow movement of surface 128 against an adjacent surface of spacer block 108.

Figure 2:
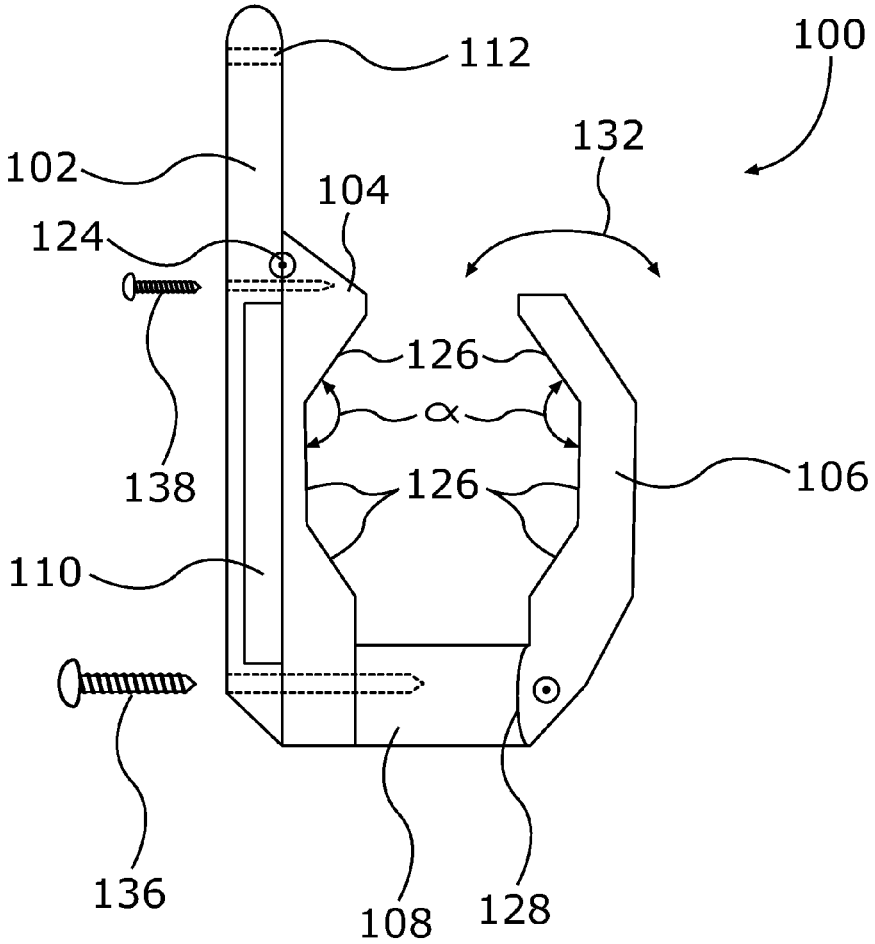
FIG. 2 is a front, elevational view of the holster of FIG. 1.
Figure 3:
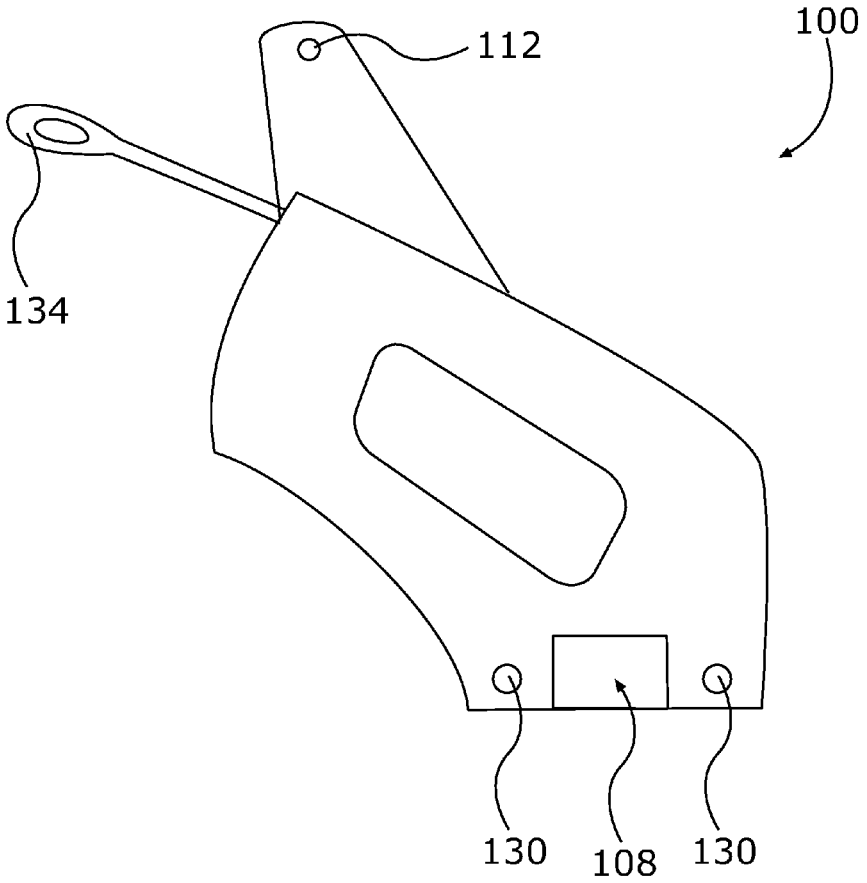
FIG. 3 is a side, elevational view of the holster of FIG. 1.
Figure 4:
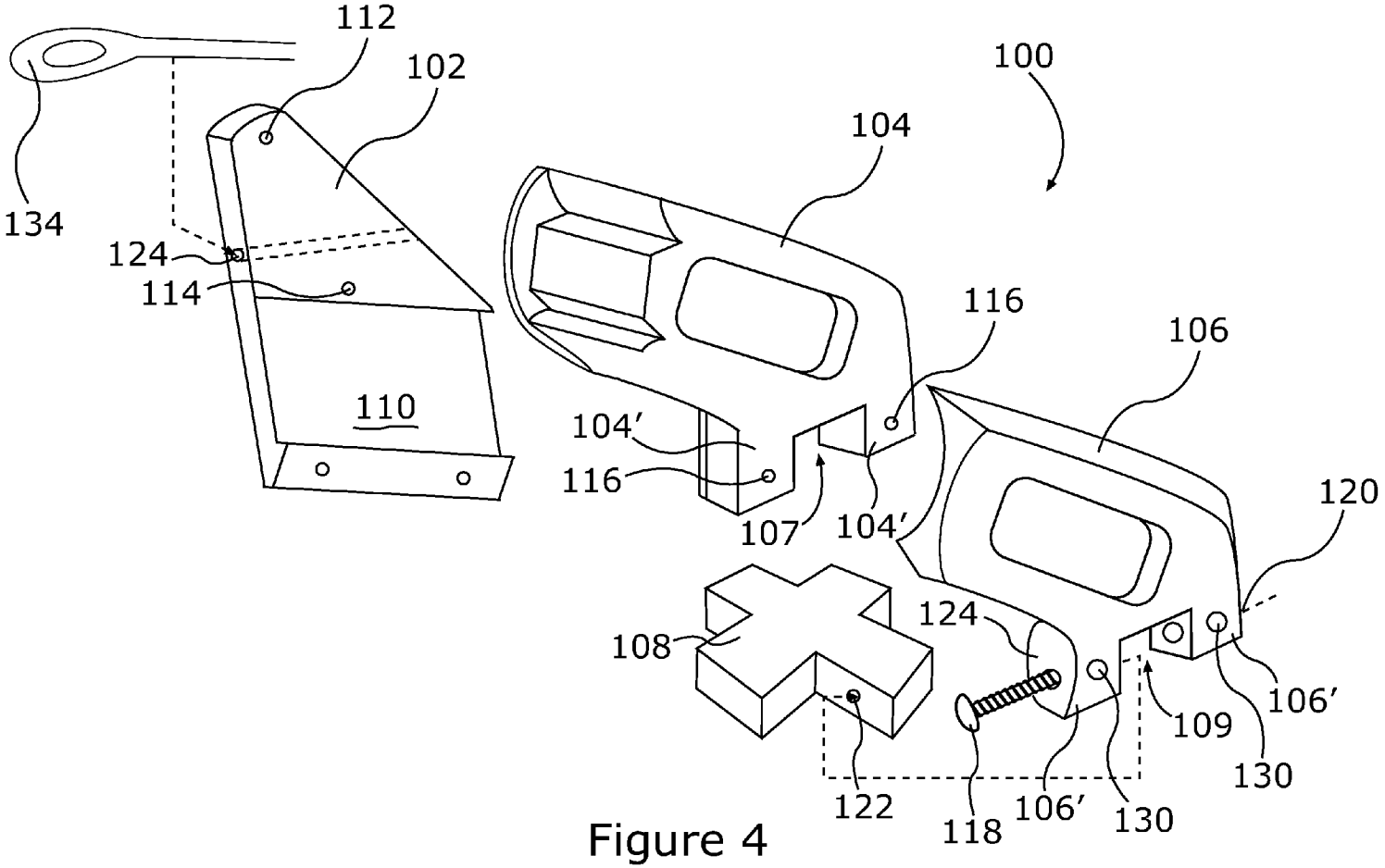
FIG. 4 is an exploded, perspective view of the holster of FIG. 1.

Screws 130 are captured by threads, not shown, in the finger protrusions 106' of outer jaw member 106 and are used to adjust outer jaw member 106 with respect to inner jaw member 104. Screws 130 extend completely through both finger protrusions 106' of outer jaw member 106 and contact respective surfaces of support block 108, causing outer jaw member 106 to rotate around pivot pin 118 in a direction indicated by arrow 132 (FIG. 2).

Because the top region 143 of holster 100 is completely open, a revolver, not shown, equipped with a scope or similar top-mounted accessory may readily be accommodated by holster 100.

Since other modifications are changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A quick-draw, stealth of movement holster for a revolver, comprising:

a) a back plate having an upper, vertical extension portion and a lower portion having a recessed belt loop region for receiving a belt therethrough;

b) an inner jaw having two spaced-apart finger protrusions extending downwardly therefrom, said inner jaw being fixedly attached to said back plate;

c) an outer jaw held in an opposing, infinitely adjustable relationship to said inner jaw, said outer jaw having two spaced-apart finger protrusions extending downwardly therefrom;

d) a spacer block having a 3-dimensional plus (+) shape and abutting said finger protrusions of said inner jaw and said finger protrusions of said outer jaw; and e) a pivot pin connecting said finger protrusions extending downwardly from said outer jaw and said spacer block, forming said holster.

2. The quick-draw, stealth of movement holster for a revolver as recited in claim 1, wherein opposing faces of at least one of said inner jaw and said outer jaw comprise at least two segmented faces displaced from one another at a predetermined angle, said at least two segmented jaw faces being adapted and configured to accommodate a cylinder region of said revolver.

3. The quick-draw, stealth of movement holster for a revolver as recited in claim 2, wherein said at least two segmented faces comprise three segmented faces.

4. The quick-draw, stealth of movement holster for a revolver as recited in claim 3, wherein said predetermined angle is substantially 45°.

5. The quick-draw, stealth of movement holster for a revolver as recited in claim 1, wherein said outer jaw is pivotally adjustable with respect to said inner jaw.

6. The quick-draw, stealth of movement holster for a revolver as recited in claim 5, wherein opposing faces of at least one of said inner jaw and said outer jaw comprise at least two segmented faces displaced from one another at a predetermined angle, said at least two segmented faces being adapted and configured to accommodate a cylinder region of said revolver.

7. The quick-draw, stealth of movement holster for a revolver as recited in claim 6, wherein said at least two segmented faces comprise three segmented faces.

8. The quick-draw, stealth of movement holster for a revolver as recited in claim 6, wherein said predetermined angle is approximately 45°.

9. A quick-draw, stealth of movement, cross-draw holster for a revolver, comprising:

a) a back plate;

b) an inner jaw having two spaced-apart finger protrusions extending downwardly therefrom, said inner jaw being fixedly attached to said back plate;

c) an outer jaw having two spaced-apart finger protrusions extending downwardly therefrom, said outer jaw being held in a spaced apart, opposing, infinitely adjustable relationship to said inner jaw;

d) a spacer block having a 3-dimensional plus (+) shape abutting said two finger protrusions of said inner jaw and said two finger protrusions of said outer jaw;

e) a pivot pin connecting one of said two finger protrusions of said outer jaw and said spacer block; and f) a hammer retaining loop removably attached to said back plate.

10. The quick-draw, stealth of movement, cross-draw holster for a revolver as recited in claim 9, wherein opposing faces of at least one of said inner jaw and said outer jaw comprise at least two segmented faces displaced from one another at a predetermined angle, said at least two segmented jaw faces being adapted and configured to accommodate a cylinder region of said revolver.

11. The quick-draw, stealth of movement, cross-draw holster for a revolver as recited in claim 10, wherein said predetermined angle is approximately 45°.

12. The quick-draw, stealth of movement, cross-draw holster for a revolver as recited in claim 9, wherein said outer jaw is pivotally adjustable with respect to said inner jaw.

13. A quick-draw, stealth of movement, cross-draw holster for a revolver, comprising:

a) an inner jaw having two spaced-apart finger protrusions extending downwardly therefrom;

b) an outer jaw held in an opposing, infinitely adjustable relationship to said inner jaw, said outer jaw having two spaced-apart finger protrusions extending downwardly therefrom;

c) a spacer block having a 3-dimensional plus (+) shape abutting said two finger protrusions of said inner jaw and said two finger protrusions of said outer jaw; and d) a pivot pin connecting one of said two finger protrusions of said outer jaw and said spacer block.

14. The quick-draw, stealth of movement, cross-draw holster for a revolver as recited in claim 13, wherein said outer jaw is pivotally adjustable with respect to said inner jaw.

15. The quick-draw, stealth of movement, cross-draw holster for a revolver as recited in claim 13, wherein opposing faces of at least one of said inner jaw and said outer jaw comprise at least two segmented faces displaced from one another at a predetermined angle, said at least two segmented jaw faces being adapted and configured to accommodate a cylinder region of said revolver.

16. The quick-draw, stealth of movement, cross-draw holster for a revolver as recited in claim 15, wherein said predetermined angle is approximately 45°.

* * * * *